US008966669B2

(12) United States Patent
Hines

(10) Patent No.: US 8,966,669 B2
(45) Date of Patent: Mar. 3, 2015

(54) SHOCK WAVE GENERATION, REFLECTION AND DISSIPATION DEVICE

(75) Inventor: James M. Hines, Houston, TX (US)

(73) Assignee: James Michael Hines, Houston, TX (US)

( * ) Notice: Subject to any disclaimer, the term of this patent is extended or adjusted under 35 U.S.C. 154(b) by 687 days.

(21) Appl. No.: 13/025,972

(22) Filed: Feb. 11, 2011

(65) Prior Publication Data

US 2011/0198788 A1 Aug. 18, 2011

Related U.S. Application Data

(60) Provisional application No. 61/304,070, filed on Feb. 12, 2010.

(51) Int. Cl.

| | |
|---|---|
| ***A42B 3/00*** | (2006.01) |
| ***F41H 5/02*** | (2006.01) |
| ***F41H 1/02*** | (2006.01) |
| ***F41H 1/04*** | (2006.01) |

(52) U.S. Cl.

CPC ..... *F41H 5/023* (2013.01); *F41H 1/02* (2013.01); *F41H 1/04* (2013.01)

USPC ..... 2/411; 2/412; 2/422

(58) Field of Classification Search

CPC ..... A42B 3/063; A42B 3/121; A42B 3/069

USPC ..... 2/2.5, 411, 412, 413, 422, 425, DIG. 3; 1/2.5, 411, 412, 413, 422, 425, DIG. 3

See application file for complete search history.

(56) References Cited

U.S. PATENT DOCUMENTS

| | | | |
|---|---|---|---|
| 3,242,500 | A | 3/1966 | Derr |
| 3,447,163 | A | 6/1969 | Bothwell et al. |
| 3,660,951 | A | 5/1972 | Cadwell |
| 3,787,893 | A | 1/1974 | Larcher |
| 3,872,511 | A | 3/1975 | Nichols |
| 3,999,220 | A | 12/1976 | Keltner |
| 4,124,904 | A | 11/1978 | Matthes |

(Continued)

FOREIGN PATENT DOCUMENTS

| | | | |
|---|---|---|---|
| EP | 0 452 463 | B1 | 10/1991 |
| WO | 91/05489 | A1 | 5/1991 |

(Continued)

OTHER PUBLICATIONS

Pavius, "Real-life Hurt Locker: how bomb-proof suits work", DVICE, five pages, available online at "http://dvice.com/archives/2010/03/hurt-locker-sui.php" (2010).

(Continued)

*Primary Examiner* — Khoa Huynh
*Assistant Examiner* — Khaled Annis
(74) *Attorney, Agent, or Firm* — Vorys, Sater, Seymour & Pease LLP; William L. Klima

(57) ABSTRACT

An outer hard-shell casing for a protection device that has airspace between the outer shell and inner shell or surface. This outer shell is designed to generate a shock wave during an impact to the casing. The generated shock wave then reflects off of the inner surface or shell. The reflected shock wave then dissipates along the air channel and out of the exit vents before it can be absorbed into the inner hard shell of the base or other protection device.

23 Claims, 10 Drawing Sheets

(56) References Cited

U.S. PATENT DOCUMENTS

| | | | | |
|---|---|---|---|---|
| 4,404,889 | A | 9/1983 | Miguel | |
| 4,937,888 | A | 7/1990 | Straus | |
| 5,181,279 | A | 1/1993 | Ross | |
| 5,221,807 | A | 6/1993 | Vives | |
| 5,349,893 | A | 9/1994 | Dunn | |
| 5,561,866 | A | 10/1996 | Ross | |
| 5,713,082 | A | 2/1998 | Bassette et al. | |
| 5,953,762 | A | 9/1999 | Corbett | |
| 5,956,777 | A | 9/1999 | Popovich | |
| 5,992,104 | A | 11/1999 | Hudak | |
| 6,032,297 | A * | 3/2000 | Barthold et al. | 2/416 |
| 6,317,895 | B1 | 11/2001 | Erth et al. | |
| 6,385,781 | B1 | 5/2002 | Rose et al. | |
| 6,425,141 | B1 | 7/2002 | Ewing et al. | |
| 6,446,270 | B1 | 9/2002 | Durr | |
| 6,467,099 | B2 | 10/2002 | Dennis et al. | |
| 6,588,022 | B1 | 7/2003 | Anders et al. | |
| 6,658,671 | B1 | 12/2003 | Von Holst et al. | |
| 6,804,829 | B2 | 10/2004 | Crye et al. | |
| 7,089,602 | B2 | 8/2006 | Talluri | |
| 7,120,941 | B2 | 10/2006 | Glaser | |
| 7,254,843 | B2 | 8/2007 | Talluri | |
| 7,341,776 | B1 | 3/2008 | Milliren et al. | |
| 7,685,922 | B1 | 3/2010 | Martin et al. | |
| 8,127,373 | B1 * | 3/2012 | Fodemski | 2/413 |
| 2006/0242752 | A1 * | 11/2006 | Talluri | 2/412 |
| 2009/0260133 | A1 | 10/2009 | Del Rosario | |
| 2010/0005571 | A1 * | 1/2010 | Moss et al. | 2/410 |
| 2010/0236393 | A1 | 9/2010 | Martin et al. | |

FOREIGN PATENT DOCUMENTS

| | | | |
|---|---|---|---|
| WO | 2008/153613 | A2 | 12/2008 |
| WO | 2009/094271 | A1 | 7/2009 |

OTHER PUBLICATIONS

ONR (Office of Naval Research), "Elastomeric Polymer-by-Design to Protect the Warfighter against Traumatic Brain Injury by Diverting the Blast Induced Shock Waves from the Head", Basic Research Challenge, two pages, available online at "http://www.onr.navy.mil/en/Science-Technology/Directorates/office-research-discovery-invention/Sponsored-Research/BRC/Elastomeric-Polymer-09.aspx" (2009).

* cited by examiner

SHOCK WAVE GENERATION, REFLECTION AND DISSIPATION DEVICE

CROSS-REFERENCE TO RELATED APPLICATIONS

This application claims the benefit of provisional patent application Ser. No. 61/304,070, filed 2010 Feb. 12 by the present inventor.

BACKGROUND

Prior Art

The following is a tabulation of some of the prior art that presently appears relevant:

| U.S. Patents | | | |
|---|---|---|---|
| U.S. Pat. No. | Kind Code | Issue Date | Patentee |
| U.S. Pat. No. 7,685,922 | B1 | 2010 Mar. 30 | Martin |
| U.S. Pat. No. 7,341,776 | B1 | 2008 Mar. 11 | Milliren |
| U.S. Pat. No. 5,349,893 | none | 1994 Sep. 27 | Dunn |
| U.S. Pat. No. 3,660,951 | none | 1972 May 9 | Cadwell |
| U.S. Pat. No. 4,404,889 | none | 1983 Sep. 20 | Miguel |
| U.S. Pat. No. 7,254,843 | B2 | 2007 Aug. 14 | Talluri |
| U.S. Pat. No. 5,992,104 | none | 1999 Nov. 30 | Hudak |
| U.S. Pat. No. 5,221,807 | none | 1993 Jun. 22 | Vives |
| U.S. Pat. No. 6,658,671 | B1 | 2003 Dec. 9 | Von Holst |
| U.S. Pat. No. 6,804,829 | B2 | 2004 Oct. 19 | Crye |

| U.S. patent application Publications | | | |
|---|---|---|---|
| Publication Nr. | Kind Code | Publ. Date | Applicant |
| US20100236393 | A1 | 2010 Sep. 23 | Martin |
| US20090260133 | A1 | 2009 Oct. 22 | Del Rosario |

| Foreign Patent Documents | | | | |
|---|---|---|---|---|
| Publication Nr. | Cntry Code | Kind Code | Pub. Dt | App or Patentee |
| W02009094271 | US | A1 | 2009 Jul. 30 | Joynt |
| W02008153613 | US | A2 | 2008 Dec. 18 | Joynt |
| EP0452463 | GB | B1 | 1997 September | Raymond |
| W01919005489 | AU | A1 | 1991 May 2 | Chapman |

NONPATENT LITERATURE DOCUMENTS

ONR (Office of Naval Research), "Elastomeric Polymer-by-Design to Protect the Warlighter against Traumatic Brain Injury by Diverting the Blast Induced Shock Waves from the Head", Basic Research Challenge, (2009).

PAVIUS, "Real-life Hurt Locker: how bomb-proof suits work", DVICE, (2010).

From the dawn of civilization people have had a tendency to get into situations where they receive physical blows. These physical blows come from many surprising sources. They can come from another person, animals, falling debris, a projectile or even the ground. To combat these blows humans have come up with many different devices from ancient shields to modern day composite armor. These devices were built to defeat the physical damage of the impact but often times there was another problem. In reality there are two forces at work when something receives a blow: the physical impact of the object striking a protection device and the shock wave that is a direct result of said impact.

Previously impact absorbing devices were designed to block a physical blow and then absorb the shock wave that resulted from the impact of said blow. The devices are designed to manage the shock wave use materials or methods that slow the wave down or trap the wave so that it no longer damages the target. Often the problem is that the shock wave is so overpowering that it still damages the protected item. The only way to prevent the damage is to add more padding in between the rigid structure and the protected item. This method becomes impractical because by adding more padding and more shielding the protection system eventually becomes too large to effectively use.

There is no device that changes the shock wave traveling from solid matter to gas then reflecting it off of another piece of solid matter for the purpose of shifting it away and out into air from the system. This change, redirection and dissipation through exiting the structure is the most effective way to defeat a shock wave.

The closest patents to this one is WO2009094271 and WO2008153613. They are layered device that is designed to defeat projectiles by using spaced layers made of various grades of specific metals and thicknesses along with shock wave reflection principles to defeat said projectiles. The element to this system is that the outer layer gets defeated by the impact of the projectile. This turns the system into a one use weapon. After being struck, the system has to be rebuilt. The WO2009094271 air pocket layers are enclosed ensuring that the shock wave generated by the projectile impact reflects back into the round causing Spalding. This reflection helps to break up the projectile. This enclosed space recompresses the wave back into the system thereby transferring it to anything that is touching the system and possibly damaging it.

There are other armored systems that manage shock waves. Many of these systems also use methods like the insertion of ceramics into metals to shape the way the waves move through the metal. There are other designs that use cavities to trap incoming shock waves but these designs still have to contend with the transference of said shock wave to the protected entity because they did not release the wave somewhere else. When the protected entity is susceptible to the residual shock wave left over during the trapping these designs fail.

This brings us to helmets. The designs that try to trap the shock wave fail at higher impact velocities. They involve using compressed air which has proven to be impractical over time because it has to be monitored and refilled. Inventive minds then turned themselves to the ideas of mechanically canceling the wave out by bouncing it around in an enclosed space thereby running the wave back into itself. While it looked great on paper, it was not fundamentally sound for several reasons. The end result was that these systems were not any more effective than the old method of shield over padding.

Other designs have tried many different shapes, sizes and mechanical means to protect the user. Many of these designs were actually more harmful to the user than they helped. A good example of this is U.S. Pat. No. 7,089,602. The size and weight of this helmet would have to be so large that it would be impractical to use in any situation due to the forces exerted on the neck during use and impact. The reason this is crucial to mention is because the helmet multiplies the load forces on the neck. The bigger the helmet the bigger the load on the neck and therefore more likely for there to be an injury.

Bullet proof vests use heavy padding behind bullet resistant material to protect humans. The problem is that these vest are very heavy and often lead to user exhaustion. Also the impact from the bullet sends a shock wave through the body that causes substantial injury. The shock wave from the impact of a bullet is usually too big for padding to absorb.

Shipping containers have suffered from the same thinking as the other applications because putting padding around a breakable item has worked so well for so long. The problem is that items still break from time to time. There are systems that include a box within a box that have spacers in them to keep the two boxes separated. They don't let the shock wave escape the container and therefore items break during a high impact.

The old protection systems suffer from a number of disadvantages:

(a). They trap the shock wave. No matter what they do the shock wave is never released out into the open air away from the protected entity. If the shock wave is trapped it will compress into the surrounding structure no matter what the shape is. This physical fact renders all of the other design that trap the shock wave inadequate for protection over a broad range of impacts.

(b). They also add so many layers of shielding and padding or conceived items that they become overloaded. They become too big to be of any practical value for use in the field.

(c). Some units surround the user with a protective system and let the shock wave pass through the physical structure of the unit and onto another part of the body or protected item. These are too big and impractical to use in the field.

(d). The compressibility of shock absorbing materials is another major problem. Designs often combine a hard shield with a soft shock absorbing substance. In theory, this soft substance diffuses the wave because it is less dense than the shield. This lessens the impact of the wave. The reality is different however. The problem with this design is that the soft substance compresses at the point of impact between the protected item and impacting object. When it compresses due to impact this makes the substance much more dense. While under compression, it is much easier for the shock wave to pass through to the protected entity.

SUMMARY

In accordance with one embodiment, the protection system comprises two layers of rigid material with an open air space in between that is open to the surrounding atmosphere.

Advantages

To provide a system that dramatically reduces the amount of damaging shock waves that enter a target area.

DRAWINGS

Figures

DRAWINGS

Reference Numbers

Figure 1:
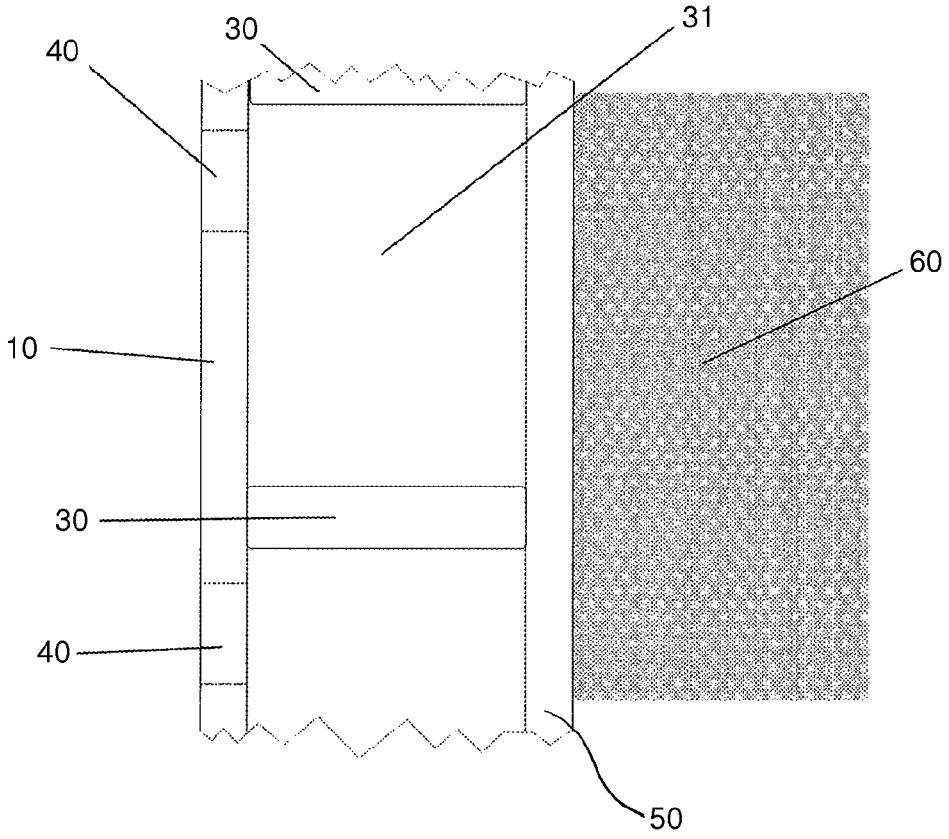
FIG. 1 shows the layout of system.

10—Shock wave generator
11—projectile stopping material
20—holder
21—strap
30—spacer
31—air gap
40—openings
50—shock wave reflector
60—protected item
70—impact object
71—Shock wave

DETAILED DESCRIPTION

Although specific terms are used in the following description for the sake of clarity, these terms are intended to refer only to the particular structure of the invention selected for illustration in the drawings, and are not intended to define or limit the scope of the invention.

Reference will now be made in detail to embodiments of the invention, examples of which are illustrated in the accompanying drawings. Wherever possible, the same reference numbers will be used throughout the drawings to refer to the same or like parts.

Referring now to the drawings, as illustrated in FIG. 1 two layers of hard material separated by spacers with an air gap that is open around the sides to the atmosphere. The outer layer 10 is the shock wave generating layer, layers or system. They can be made of any substance that defeats an impact. In this outer layer there may be an opening or openings 40 that help the shock wave to exit. Downstream from the impact is the open air space 31 this is where the shock wave makes a medium change form a solid to a gas. Inside this airspace are the spacers 30. They can be of any size, made of any material or of any mechanical device for a means deemed appropriate to keep the distance between the two layers correct, keep the two layers from touching each other during impact and they may help perform a dampening effect from shock waves.

The inner layer 50 is the reflective layer. This can also be made of any material and be of any size. The two layers and the spacers can be held together by various means as long as the space in between is not obstructed to the outside atmosphere. The layers can be attached to the spacers 30 or they can be held together by various fasteners, straps, clamps, etc.

Figure 1A:
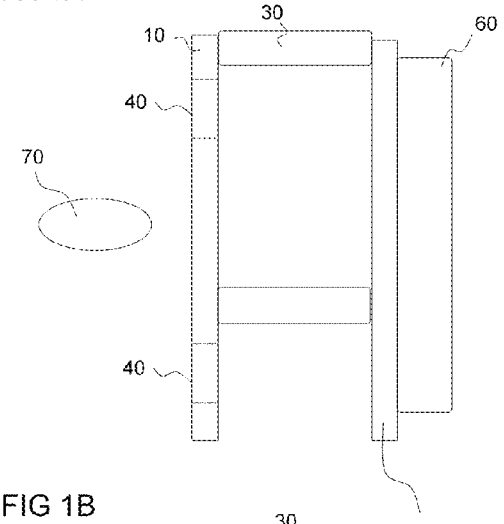
FIGS. 1A to 1C show the various stages of impact.
Figure 1B:
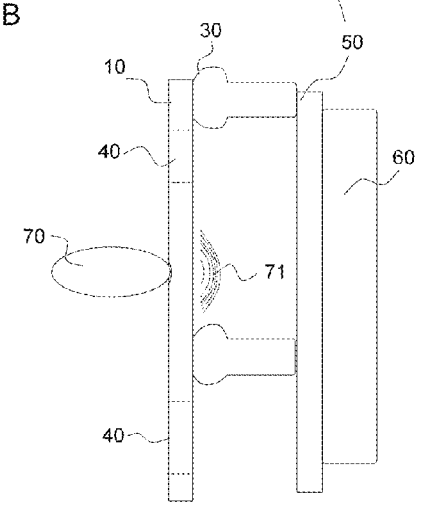
Figure 1C:
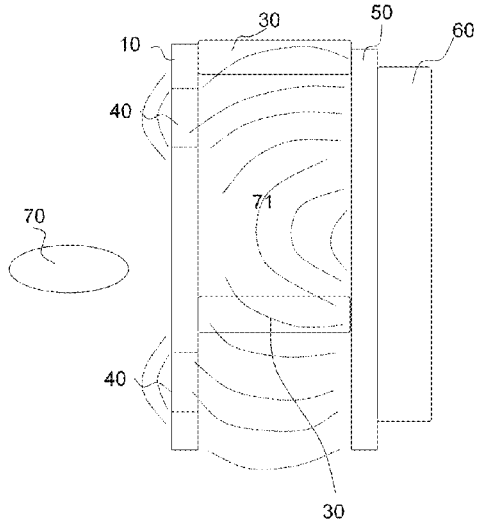

The function of the device upon impact is shown in FIGS. 1A, 1B and 1C. FIG. 1A shows a projectile impacting the outer layer 10. The layer defeats said projectile and a shock wave forms. In FIG. 1B the projectile continues moving the outer layer 10 toward the inner layer 50. The spacers 30 keep the two layers from touching and the shock wave reaches the inner layer 50. in FIG. 1C the projectile moves away from the outer layer 10. The shock wave reflects off of the inner layer 50. The wave then travels through the air gap 31 and out into the open atmosphere through the sides and or openings 40.

Figure 2:
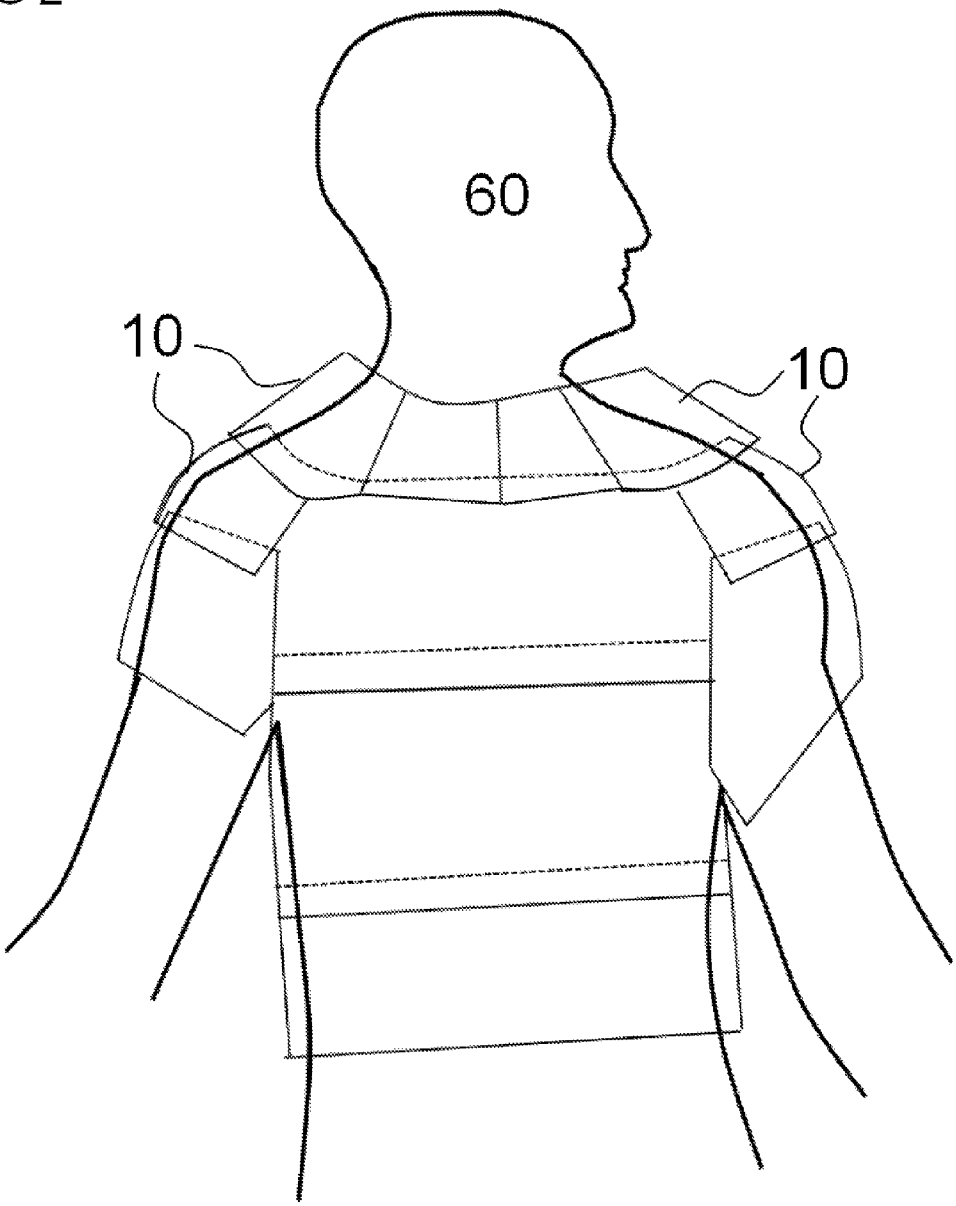
FIG. 2 shows the front of the bullet-proof jacket.
Figure 3:
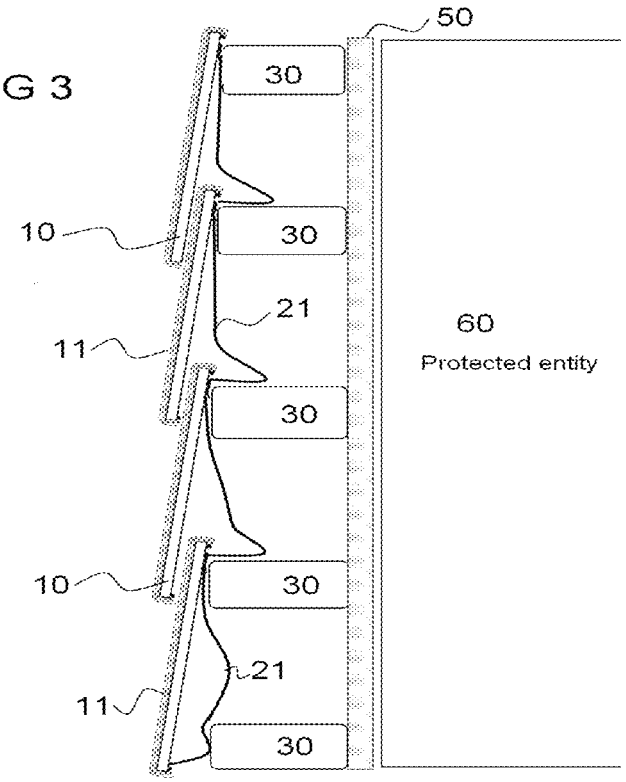
FIGS. 3 and 3A shows the panels of the bullet-proof jacket in the pre impact and post impact modes.
Figure 3A:
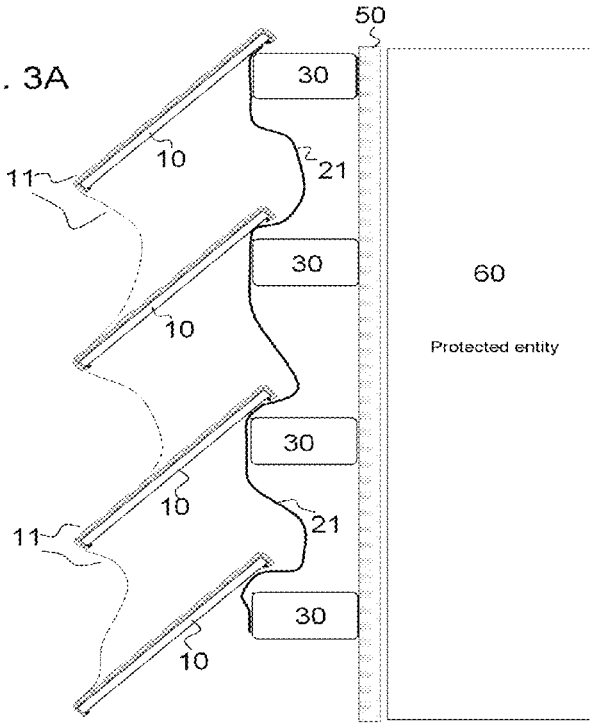

Additional embodiments are shown in FIGS. 2 and 3. This configuration is a bullet resistant vest. In this case the vent holes are impractical as they could let a bullet through so there are none. The way the air is vented out of the system is that the outer layer 10 consists now of small free floating sections of armor that overlap each other. The pieces of bullet resistant armor are covered with bullet resistant fabric 11. These are strapped 21 onto the spacers 30. The straps 21 are then attached down to each plate 10. The spacers 30 are attached to the inner layer 50. This system is then used to protect an entity 60.

Operation

When the outer layer 10 is struck a massive shock wave is formed. The wave reflects off of the inner layer 50. Since the top part of each plate 10 is held on the spacers 30 by a strap 21, the force of the wave only pushes the bottom part floating sections 10 open to let the shock wave exit the vest. The outer layers then use gravity to close because there is no shock wave force to keep them open.

Figure 4:
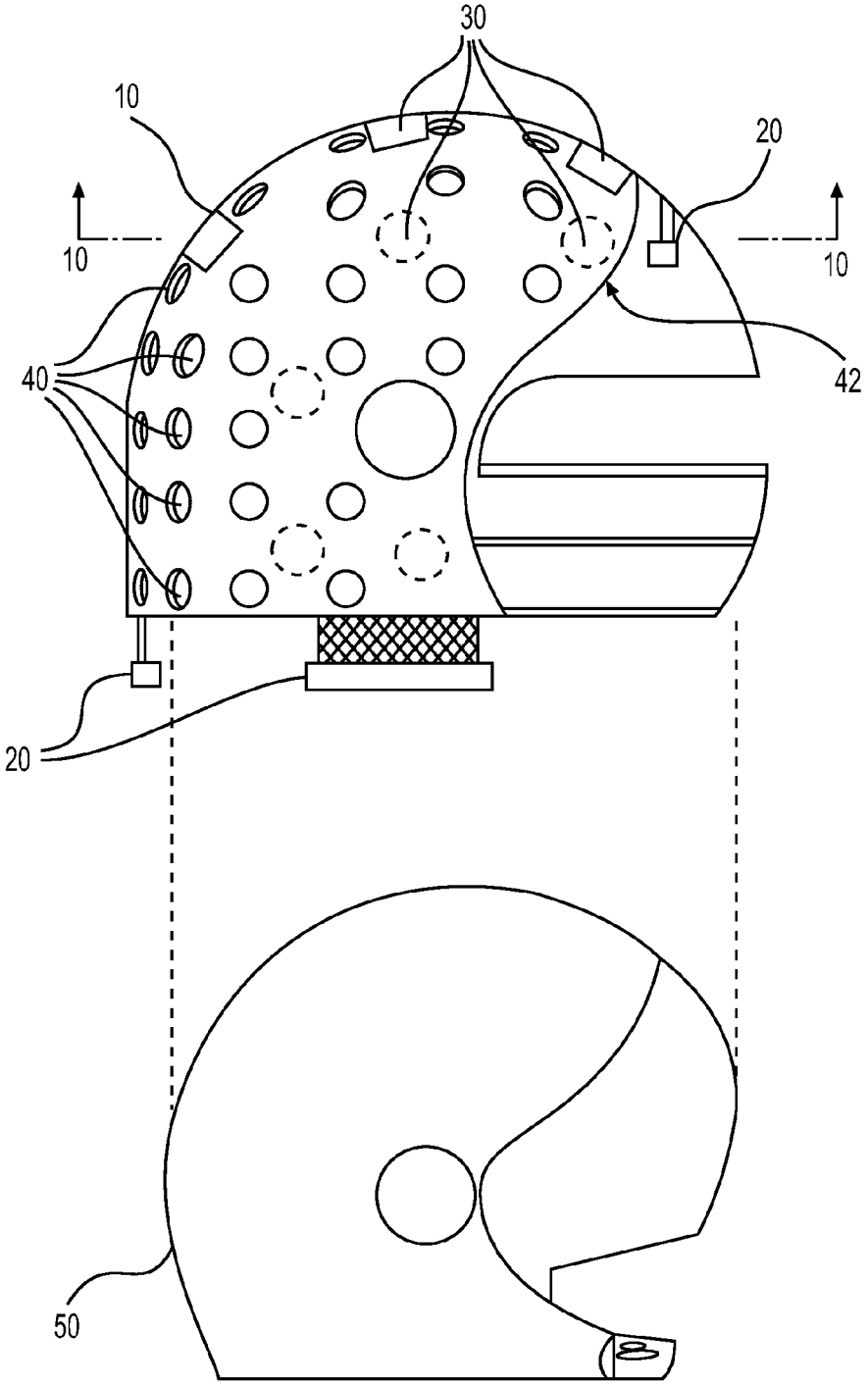
FIG. 4 is left side view with the inner helmet below the outer shield.
Figure 5:
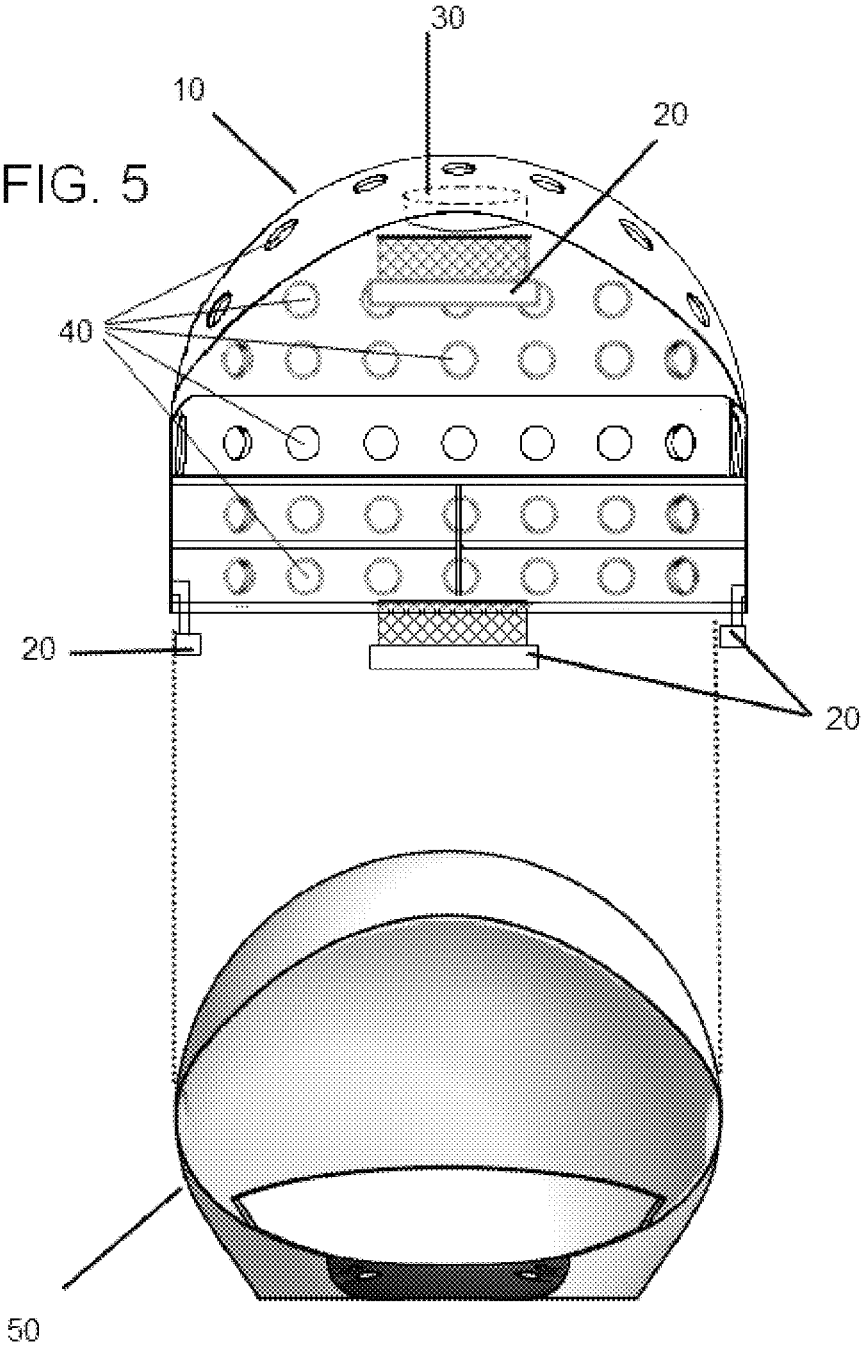
FIG. 5 is the front view with the inner helmet below the outer shield.
Figure 6:
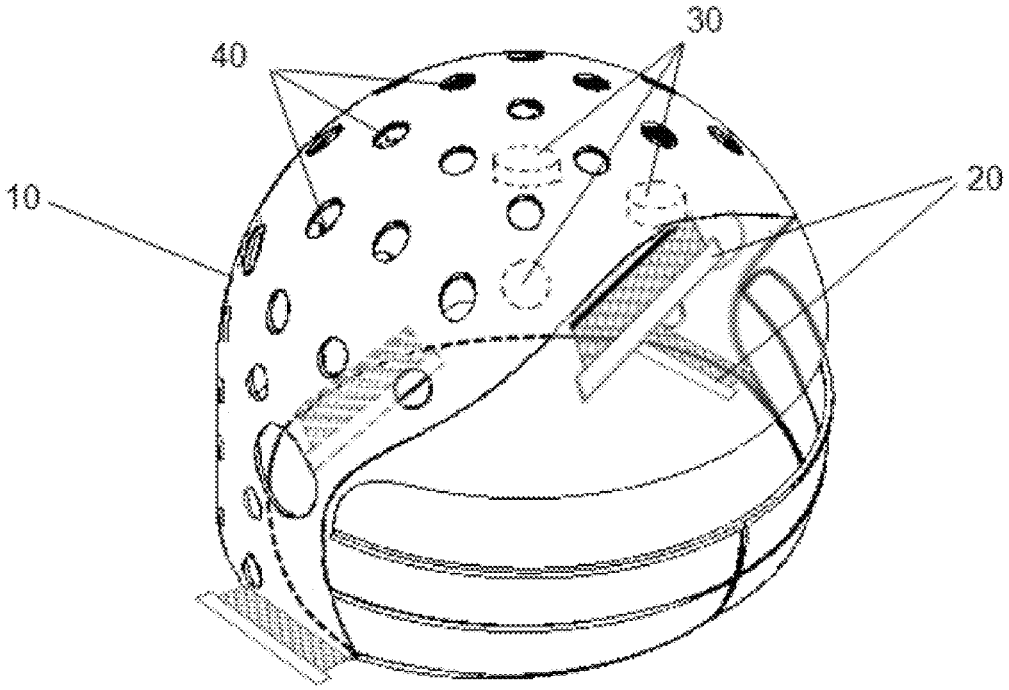
FIG. 6 is the isometric view with the inner helmet below

Additional embodiments are shown in FIGS. 4, 5, and 6. This is a protector for a helmet. The outer layer 10 is the helmet cover and the inner layer 50 is the helmet itself. The spacers 30 are attached to the inside of the outer layer 10. It also has the openings 40 for the shock wave to exit. This embodiment has the clamps 20 that allow the shield to be taken off whenever necessary. In FIG. 6 shows the opening on the bottom and between the outer and inner layers.

FIG. 1 is representative of the construction of the helmet protector and helmet shown in FIGS. 4 thru 6. The helmet protector can comprise the helmet cover 10 and spacers 30, which can be installed on a separate helmet 50. Alternatively, a helmet or helmet combination can comprise the helmet cover 10, spacers 30, and helmet 50 assembled together as a unit. Both the helmet cover 10 and helmet 50 can be made of a hard material. The spacers 30 bridge between the helmet cover 10 and the helmet 50. More specifically, the spacers 30 bridge between an inner surface of the helmet cover 10 and an outer surface of the helmet 50 (See FIG. 1 specifically showing this configuration or arrangement). Further, the spacers 30 are shown in FIGS. 4-6 as being circular-shaped with round sides. The spacers 30 extend through the air space located between the helmet cover 10 and helmet 50, as shown in FIGS. 1, 1A, 1B, and 1C.

Figure 10:
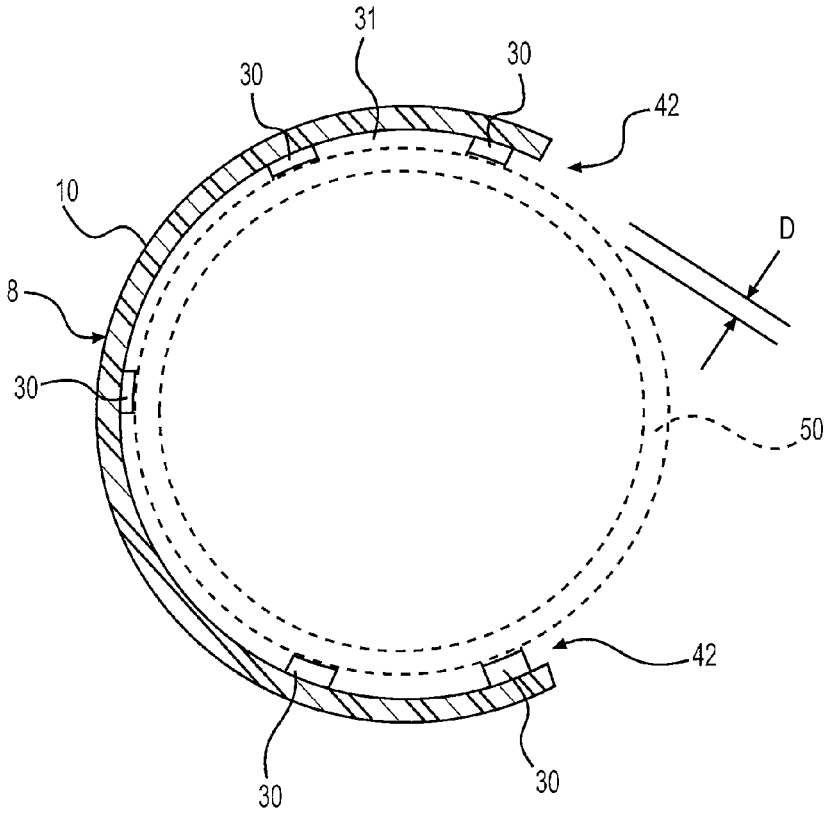
FIG. 10 is a cross-sectional view of the helmet fitted with the helmet protector, as indicated in FIG. 4.

As shown in FIG. 10, a side opening 42 is provided between the helmet (inner layer 50) and helmet cover (outer layer 10) of the helmet protector 8 due to the spacers 30 supporting the helmet cover (outer layer 10) a predetermined distance D from the helmet (inner layer 50).

As shown in FIGS. 4-6 and 10, the helmet protector 8 for the helmet (inner layer 50) comprises a helmet cover (outer layer 10) surrounding at least a portion of the helmet and defining the air space 31 extending between the helmet (inner layer 50) and helmet cover (outer layer 10) when the helmet protector 8 is installed on the helmet (inner layer 50). The helmet cover (outer layer 10) comprises at least one opening 40 (or multiple openings 40) providing an air passageway from the air space 31 to the open atmosphere. The at least one spacer 30 (or multiple spacers 30) supports the helmet cover (outer layer 10) a predetermined distance away from the helmet (inner layer 50) when the helmet protector 8 is installed on the helmet (inner layer 50). Further, the at least one spacer 30 (or multiple spacers 30) bridges the helmet (inner layer 50) helmet cover (outer layer 10) through the air space when the helmet protector 8 is installed on the helmet (inner layer 50). For example, the at least one spacer 30 bridges between the inner side of the helmet cover (outer layer 10) and inner side of the helmet (inner layer 50) through the air space 31. In addition, the air space 31 is unobstructed between at least a portion of the helmet (inner layer 50) and helmet cover (outer layer 10) when the helmet protector 8 is installed on the helmet (inner layer 50) to allow for propagation of waves generated by an impact to the helmet protector 8 through the unobstructed air space 31 and exiting through the at least one opening 40 to dissipate energy from the impact. In addition, for example, at least one side of the at least one spacer 30 (or spacers 30) defines the air space 31. As another example, the at least one spacer 30 is surrounded by the air space 31.

Operation

This embodiment relies on the openings 40 and the opening at the bottom of the two layers for maximum shock wave dispersal. When the outer layer 10 is impacted and defeated a shock wave forms. The spacers 30 compress but don't let the two layers touch. The shock wave then bounces off of the inner layer 50 and moves along the air space 30 in the middle of the two layers. The shock wave then exits through all of the openings 40 and harmlessly into the surrounding atmosphere.

Figure 7:
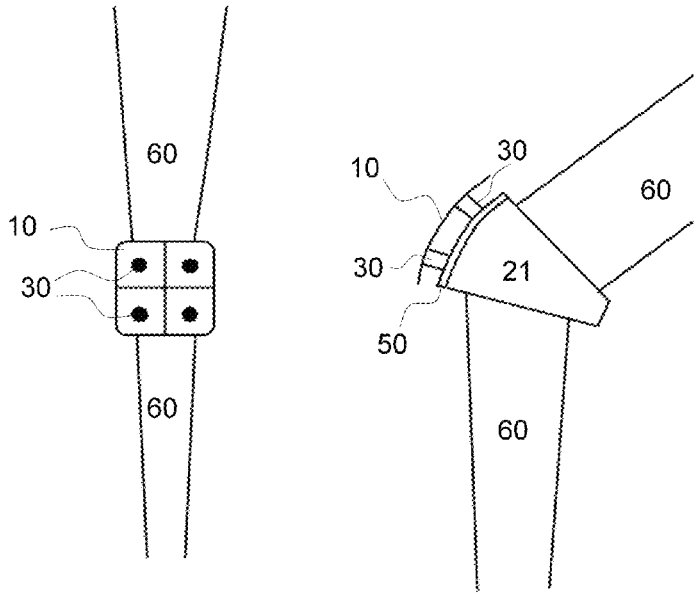
FIG. 7 is the joint protector
Figure 8:
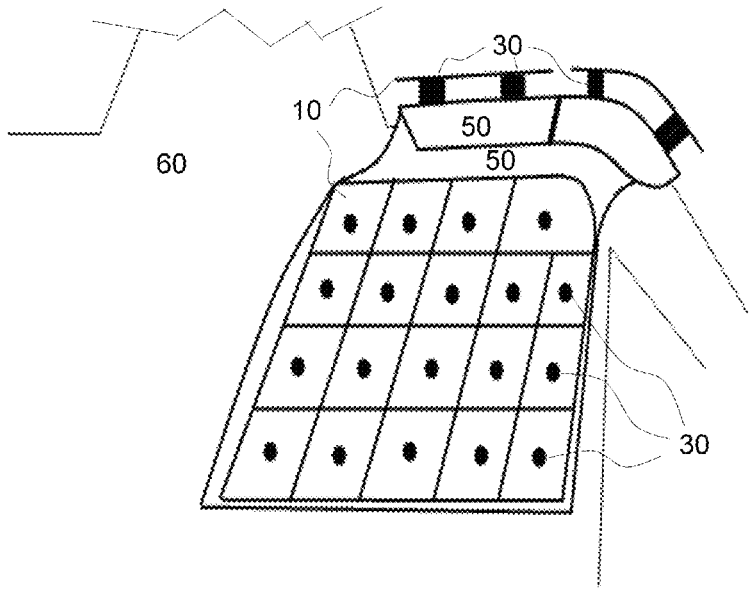
FIG. 8 is the shoulder pads

Another additional embodiment is shown in FIGS. 7 and 8. These two embodiments show the floating plate system use in joint protectors and shoulder pads. Here the outer layers 10 are a series of plates that float over the inner layers 50. They are attached to the spacers 30 and have no sides so they are open to the atmosphere.

Operation

In this embodiment the holes are now redundant because when the outer layer 10 plates are impacted only the spacers 30 of the impacted sections arc compressed. The reflected shock wave can now exit the openings between the plates as well as out of the side.

Figure 9:
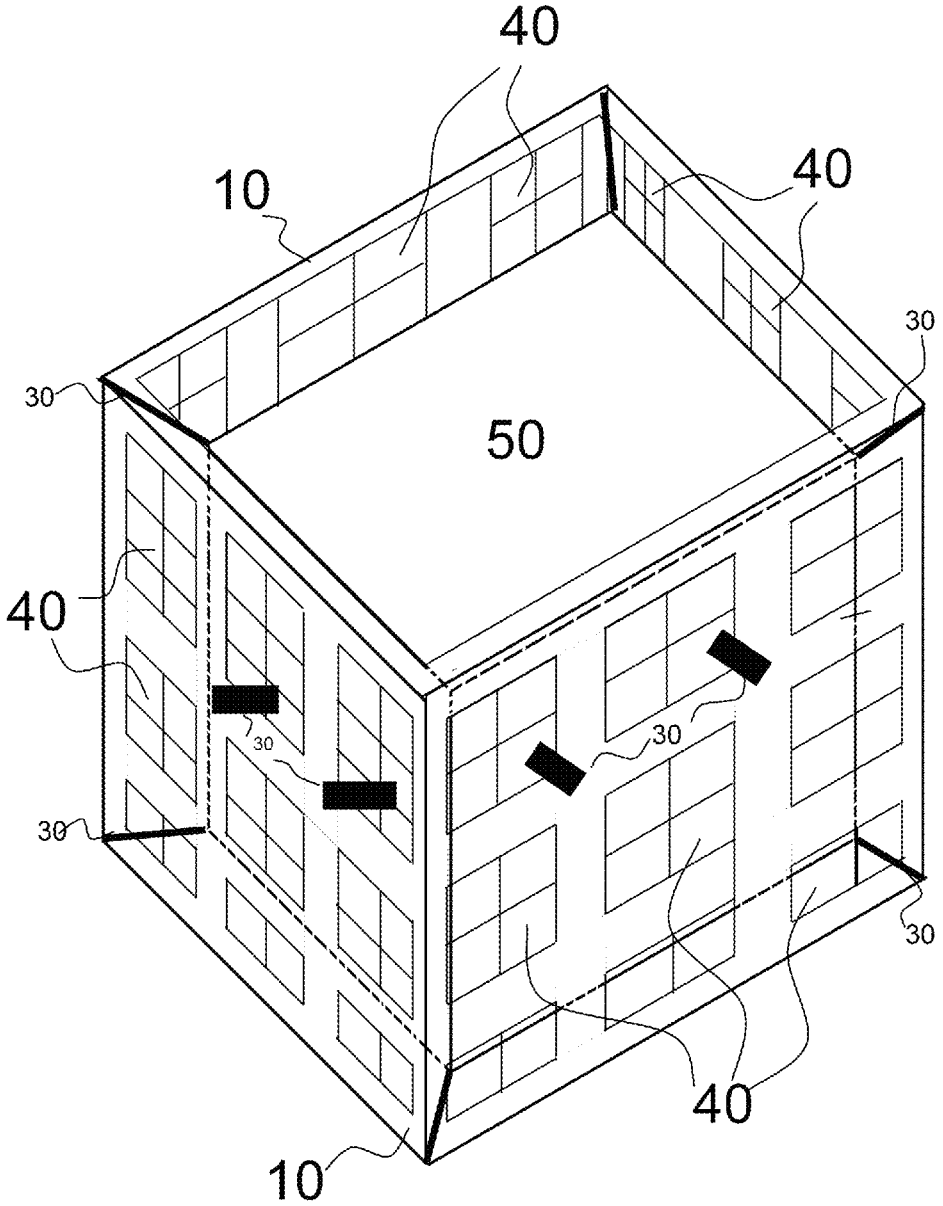
FIG. 9 is the shipping system

Additional embodiment for the safe transportation of items is shown in FIG. 9. The outer layer 10 is a box structure as is the inner layer 50. The spacers 30 hold the inner box 50 from all directions inside the outer box 10. Since there are no sides for the shock wave to exit the openings 40 must be large. The box is therefore a series of strong bands naturally making the openings 40 square shaped.

Operation

In this embodiment a part of the box is impacted or the container carrying it is impacted. The shock wave travels through the outer layer 10 and is transformed into a gas in the air gap 31. The spacers 30 compress very little. The shock wave then reflects off of the inner layer 50 and out the openings of the box 40.

Advantages

From the description above, a number of advantages of some embodiments of my shock wave generation, reflection and dissipation device.

(a) There is a significant reduction of the intensity of a shock wave that reaches the protected entity.

(b) The systems will usually be lighter than other systems that do the same job.

(c) The outer layer has the ability to move thus defecting some of the incoming energy.

Conclusion, Ramifications, and Scope

Accordingly the reader will see that, according to bullet proof vest embodiment of the invention, I have provided a much more efficient way to handle the damaging causing waves caused by the defeat of a bullet hitting a target. The system is lighter than the padding used so it does not tire the user out with too much weight. The system is cooler than the other methods because it allows free air flow thus allowing heat to escape easier. The helmet embodiment brings many of the same benefits as the vest to helmets while adding added neck protection and vision enhancement.

While the above description contains many specificities, these should not be construed as limitations on the scope of any embodiment, but as exemplification of various embodiments thereof, Many other ramifications and variations arc possible within the teachings of the various embodiments. For example, the system can have odd shapes to accommodate the protection different sized items; the system can be modified to protect passengers on vehicles; the size and shape of the vent holes will be different for different applications, etc.

Thus the scope of the embodiments should be determined by the appended claims and their legal equivalents, rather than by the examples given.

The invention claimed is:

1. A helmet protector used in combination with a conventional helmet having a hard helmet outer layer adapted to be exposed to the atmosphere and configured to directly contact with another hard helmet outer layer of another helmet or another helmet protector when being worn by a user, the helmet protector comprising:

a helmet protector cover, the helmet protector cover comprising a hard helmet protector layer, the helmet protector cover surrounding at least a portion of the helmet and defining an air space extending between the hard helmet protector cover layer and the hard helmet outer layer when the helmet protector is installed onto the helmet, the helmet protector cover having at least one opening providing an air passageway from the air space to the atmosphere located outside the helmet protector; and a plurality of spacers separating the helmet protector cover away from the helmet when the helmet protector is installed directly on the hard helmet outer layer of the conventional helmet, each of the plurality of spacers being separate discrete spacers spaced apart from each other and located at different positions on the helmet protector cover, and bridging the helmet and helmet protector cover through the air space when the helmet protector is installed on the helmet, wherein the air space surrounds the spacers and is unobstructed between the hard layer of the helmet protector cover and the hard helmet outer layer when the helmet protector is installed on the helmet to allow for propagation of waves generated by an impact to the hard outer layer of the helmet protector cover through the unobstructed air space to the hard helmet outer layer of the helmet, which reflects the waves back through the unobstructed air space and then exiting through the at least one passageway of the helmet protector to the outside atmosphere to dissipate energy from the impact to the helmet protector.

2. The helmet protector according to claim 1, wherein the at least one air passageway is a plurality of openings.

3. The helmet protector according to claim 2, wherein each spacer is located between a pair of adjacent openings through the helmet cover.

4. The helmet protector according to claim 2, wherein the plurality of openings are spaced apart on the helmet cover.

5. The helmet protector according to claim 4, wherein the plurality of openings are arranged in a pattern on the helmet cover.

6. The helmet protector according to claim 5, wherein the plurality of openings are arranged in a matrix pattern on the helmet cover.

7. The helmet protector according to claim 6, wherein each spacer is located between four openings in a square arrangement of the matrix pattern on the helmet cover.

8. The helmet protector according to claim 1, wherein the at least one air passageway is a round through hole in the helmet cover.

9. The helmet protector according to claim 1, wherein the at least one opening air passageway is configured to allow a shock wave to exit the air space through the helmet cover.

10. The helmet protector according to claim 1, wherein the hard outer layer of the helmet cover is a single layer made of the hard material.

11. The helmet protector according to claim 10, wherein the at least one connector is configured to removably connect the helmet protector to the helmet.

12. The helmet protector according to claim 1, further comprising at least one connector for connecting the helmet protector to the helmet.

13. The helmet protector according to claim 12, wherein the at least one connector is configured to grip a lower edge of the helmet to retain the helmet protector onto the helmet.

14. The helmet protector according to claim 1, wherein the at least one connector is a plurality of connectors.

15. The helmet protector according to claim 14, wherein the plurality of connectors comprise a pair of side connectors and a front connector and a rear connector.

16. The helmet protector according to claim 1, wherein the helmet protector is configured so that the helmet nests within the helmet protector.

17. The helmet protector according to claim 16, wherein the air space and spacers separate the entire helmet cover from the helmet when the helmet cover is installed on the helmet.

18. The helmet protector according to claim 1, wherein at least one spacer is located adjacent to a front edge of the helmet protector.

19. The helmet protector according to claim 1, wherein at least one spacer holds the helmet cover off or away from an outer surface of the helmet to provide a side opening between the air space and atmosphere.

20. The helmet protector according to claim 1, wherein each spacer is attached inside the helmet protector.

21. A helmet protector comprising the conventional helmet and the helmet protector according to claim 1, the helmet protector being fitted onto the conventional helmet.

22. The helmet protector according to claim 1, wherein the spacers are circular-shaped and the air space surrounds round sides of the spacers within the air space.

23. A helmet protector used in combination with a conventional helmet having a hard helmet outer layer adapted to be exposed to the atmosphere and configured to directly contact with another hard helmet outer layer of a helmet or another helmet protector when being worn by a user, the helmet protector comprising:

a helmet protector cover, the helmet protector cover comprising a hard helmet protector cover layer, the helmet protector cover surrounding at least a portion of the helmet and defining an air space extending between the hard helmet protector cover layer and the hard helmet outer layer when the helmet protector is installed onto the helmet, the helmet protector cover comprising a plurality of openings defined by through holes providing a plurality of air passageways from the air space to the atmosphere located outside the helmet protector; and a plurality of spacers separating the helmet protector cover from the helmet when the helmet protector is installed directly on the hard helmet outer layer of the conventional helmet, each of the plurality of spacers being separate discrete spacers spaced apart from each other and located at different positions on the helmet protector cover, and bridging the helmet and the helmet protector cover through the air space when the helmet protector is installed on the helmet, the plurality of spacers being located at different positions on the helmet protector cover relative to locations of the through holes, wherein the air space surrounds the spacers and is unobstructed between the hard helmet protector cover and the hard helmet outer layer when the helmet protector is installed on the helmet to allow for propagation of waves generated by an impact to the helmet protector cover through the unobstructed air space to the hard helmet outer layer, which reflects the waves back through the unobstructed air space and then exiting through the plurality of openings of the helmet protector cover to dissipate energy from the impact to the helmet protector.

* * * * *